United States Patent [19]

Levy et al.

[11] Patent Number: 5,054,667

[45] Date of Patent: Oct. 8, 1991

[54] BOOT REMOVER WITH CONE DRIVEN PLATES TO CLAMP HEEL FROM SIDES

[76] Inventors: Sol Levy, 1860 E. 12 St., Brooklyn, 11229; George Spector, 233 Broadway, New York City, both of N.Y. 10007

[21] Appl. No.: 570,011

[22] Filed: Aug. 20, 1990

[51] Int. Cl.[5] ..... A47G 25/80

[52] U.S. Cl. ..... 223/116; 223/114; 223/113; 223/111

[58] Field of Search ..... 223/114, 115, 116, 113, 223/111, 120; D2/642, 641

[56] References Cited

U.S. PATENT DOCUMENTS

| | | | |
|---|---|---|---|
| 199,557 | 1/1878 | Lauffer | 223/116 |
| D. 224,460 | 7/1972 | Wright | 223/115 |
| 530,080 | 12/1894 | Bisaiz | 223/114 |
| 3,784,067 | 1/1974 | Hicks | 223/114 |
| 3,964,117 | 6/1976 | Fox | 223/114 |
| 4,760,942 | 8/1988 | Kadar | 223/114 |

FOREIGN PATENT DOCUMENTS

| | | | |
|---|---|---|---|
| 4878 | 2/1878 | Fed. Rep. of Germany | 223/116 |

*Primary Examiner*—Werner H. Schroeder
*Assistant Examiner*—Bibhu Mohanty

[57] ABSTRACT

A boot remover is provided and consists of a structure for angularly positioning a platform on a floor with its V-shaped forked end elevated therefrom. When a person steps on the platform it will be retained in a stationary position. The V-shaped forked end will hold a boot heel securely to allow the person to withdraw their foot from the boot. When stepping on the platform, a wedge engages and forces two jaws together to grip the sides of the heel. Springs provide snap action.

2 Claims, 1 Drawing Sheet

BOOT REMOVER WITH CONE DRIVEN PLATES TO CLAMP HEEL FROM SIDES

BACKGROUND OF THE INVENTION

The instant invention relates generally to footwear accessories and more specifically it relates to a boot remover which provides a structure for holding a boot secure while the foot is being withdrawn from the boot.

There are available various conventional footwear accessories which do not provide the novel improvements of the invention herein disclosed.

SUMMARY OF THE INVENTION

A primary object of the present invention is to provide a boot remover that will overcome the shortcomings of the prior art devices.

Another object is to provide a boot remover that has a stationary angular platform with a V-shaped forked end for holding a heel of a boot secure so that the foot of a person can be withdrawn from the boot.

An additional object is to provide a boot remover that contains a mechanism for gripping the heel of the boot snugly so that the foot can be removed quickly from the boot.

A further object is to provide a boot remover that is simple and easy to use.

A still further object is to provide a boot remover that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims. cl BRIEF DESCRIPTION OF THE DRAWING FIGURES FIG. 1 is a perspective view of the invention.

DETAILED DESCRIPTION OF THE PREFERRED EMBODIMENTS

Figure 1:
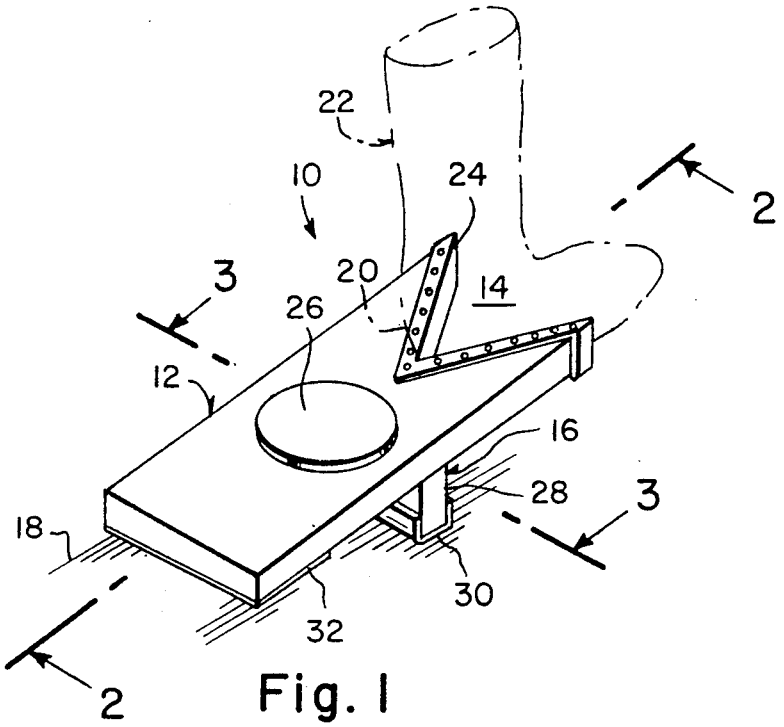
Figure 2:
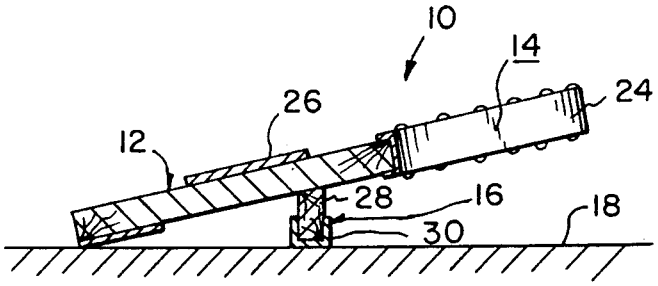
FIG. 2 is a cross sectional view taken along line 2—2 in FIG. 1.

Turning now descriptively to the drawings, in which similar reference characters denote similar elements throughout the several views, FIGS. 1 and 2 illustrate a boot remover 10 consisting of a platform 12 having a V-shaped forked end 14. A structure 16 is on the platform 12 for angularly positioning the platform on a floor 18 with the V-shaped forked end 14 elevated therefrom. When a person steps on the platform 12 with a first boot, the platform 12 will be retained in a stationary position. The V-shaped forked end 14 will hold the heel 20 of a second boot 22 securely to allow the person to withdraw their foot from the second boot 22.

A protector pad 24 is secured to the V-shaped forked end 14 to protect the heel 20 of the second boot 22 that is held thereto. A plate 26 is on the top of the platform 12 to be stepped on by the first boot.

The structure 16 includes a short leg 28 extending across the middle of the bottom surface of the platform 12. A foot pad 30 is affixed to the bottom of the short leg 28 and a bearing pad 32 is fixed to the bottom surface of the platform 12 opposite from the V-shaped forked end 14 so that the foot pad 30 and the bearing pad 32 will prevent slippage of the platform 12 on the floor 18.

Figure 3:
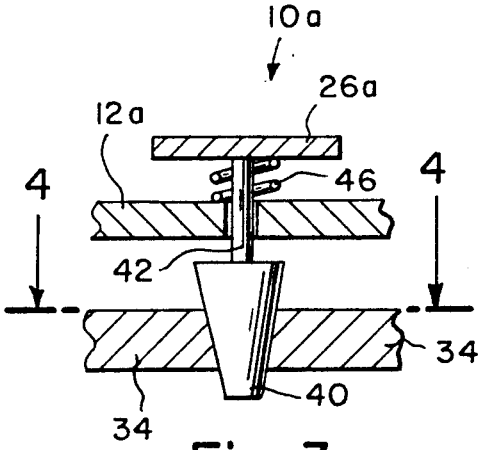
FIG. 3 is a cross sectional view taken along line 3—3 in FIG. 1, showing a modification in which pressure on the top plate will cause two jaws within the platform to move together to grip the boot snugly so that the foot can be removed from a boot.
Figure 4:
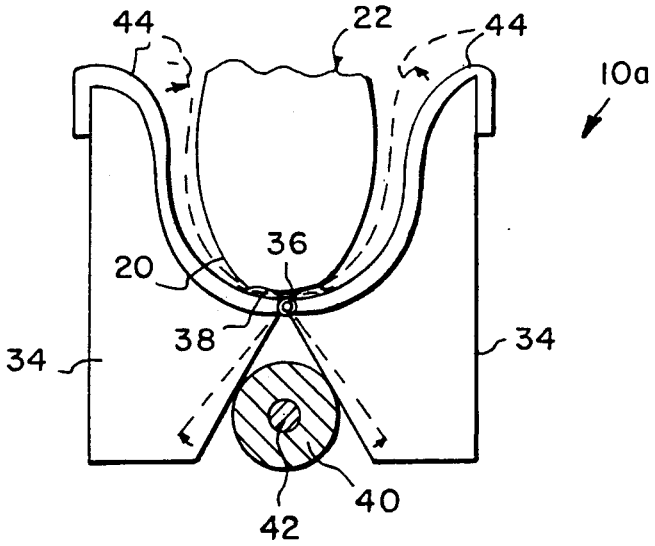
FIG. 4 is a cross sectional view taken along 4—4 in FIG. 3 showing the two jaws and cone wedge in better relationship.

FIGS. 3 and 4 show part of a modified boot remover **10*a* that contains a pair of jaws 34 pivotly connected together at 36 within the platform 12*a* at the V-shaped forked end. A coil spring 38 is carried on the pivot 36 of the jaws 34 to normally keep the jaws apart. A cone shaped wedge 40 has a shaft 42 that is connected to the bottom of the plate 26*a* so that the cone shaped wedge 40 can engage with the jaws 34 when pressure is applied to the plate 26*a* by the first boot. This causes the jaws 34 to move together to grip the heel 20 of the second boot 22 snugly. A protector line 44 is affixed to each jaw 34 to protect the heel 20 of the second boot 22. A compression spring 46 is on the shaft 42 between the plate 26*a* and the platform 12*a* to normally bias the plate 26*a* in an upward position to disengage the cone shaped wedge 40 from the jaws 34**.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A boot remover comprising:

a) a platform having a forked end;

b) means on said platform for positioning said platform on a floor with said forked end elevated therefrom, so that when a person steps on said platform with a first boot, said platform will be retained and said forked end will hold the heel of a second boot securely to allow the person to withdraw their foot from the second boot;

c) a plate movably mounted above said platform to be stepped on by the first boot;

d) a pair of jaws pivotly mounted below said platform at said forked end;

e) a coil spring carried on said pivotly connected jaws to normally keep said jaws apart;

f) a wedge engaging said jaws having a shaft that is connected to the bottom of said plate whereby said wedge moves said jaws together when pressure is applied to said plate by the first boot thus causing said jaws to grip the heel of the second boot snugly; and g) a compression spring between said plate and said platform to normally bias said plate in an upward position to release said jaws.

2. A boot remover as recited in claim 1, wherein said jaws have a forward boot gripping portion and a rear portion pivotly connected between said portions and wherein said wedge engages said rear portion.

* * * * *